United States Patent [19]

Curtis et al.

[11] 4,067,734

[45] Jan. 10, 1978

[54] TITANIUM ALLOYS

[75] Inventors: Roland E. Curtis, Albany, Oreg.; Peter T. Finden, Bellevue, Wash.

[73] Assignee: The Boeing Company, Seattle, Wash.

[21] Appl. No.: 515,891

[22] Filed: Oct. 18, 1974

Related U.S. Application Data

[63] Continuation of Ser. No. 337,647, March 2, 1973, abandoned.

[51] Int. Cl.[2] ..... C22C 14/00

[52] U.S. Cl. ..... 75/175.5; 148/32.5; 148/133

[58] Field of Search ..... 75/175.5; 148/32, 32.5, 148/133

[56] References Cited

U.S. PATENT DOCUMENTS

| | | | |
|---|---|---|---|
| 2,754,204 | 7/1956 | Jaffee et al. | 75/175.5 |
| 2,804,409 | 8/1957 | Kessler et al. | 75/175.5 |
| 2,819,958 | 1/1958 | Abkowitz et al. | 75/175.5 |
| 2,868,640 | 1/1959 | Butler | 75/175.5 |
| 2,893,864 | 7/1959 | Harris et al. | 75/175.5 |
| 3,113,227 | 12/1963 | Bomberger et al. | 75/175.5 |
| 3,469,975 | 9/1969 | Bertea et al. | 75/175.5 |
| 3,595,645 | 7/1971 | Hunter et al. | 75/175.5 |
| 3,615,378 | 10/1971 | Bomberger | 75/175.5 |

FOREIGN PATENT DOCUMENTS

| | | | |
|---|---|---|---|
| 772,339 | 4/1957 | United Kingdom | 75/175.5 |
| 776,440 | 6/1957 | United Kingdom | 75/175.5 |

*Primary Examiner*—C. Lovell

*Attorney, Agent, or Firm*—Christensen, O'Connor, Garrison & Havelka

[57] ABSTRACT

Disclosed are alloys of titanium possessing improved combinations of strength, toughness and stress corrosion resistance. These titanium alloys contain from 3.8 to 5.3% Al, up to 4.0% Zr, 2.5 to 4.25% Mo, 2.5 to 4.25% V, up to 1.25% Fe, up to 2.2% Cr and up to 1.0% Ni.

8 Claims, No Drawings

TITANIUM ALLOYS

This is a continuation of application Ser. No. 337,647, filed Mar. 2, 1973, now abandoned.

BACKGROUND OF THE INVENTION

This invention relates to titanium alloys, and more particularly to titanium alloys possessing improved combinations of strength, toughness and stress corrosion resistance. The alloys of this invention are especially useful in airframe structure applications.

Prior to 1965, the titanium alloy Ti-8Al-1Mo-1V was the primary titanium alloy under consideration for use in the U.S.A. supersonic transport. It was found, however, that this alloy is highly susceptible to a form of stress corrosion cracking. This cracking phenomenon is exhibited when a cracked specimen is simultaneously stressed and exposed to an aqueous environment and is particularly severe in salt water environments. Under a sustained stress as low as 15% of the tensile yield strength, crack propagation occurs until the specimen fractures completely. Because of this stress corrosion cracking phenomenon, Ti-8Al-1Mo-1V was abandoned for use in the SST program and Ti-6Al-4V became the primary structural alloy because of its better resistance to stress corrosion cracking. However, Ti-6Al-4V still showed susceptibility to stress corrosion cracking. This fact led to the development of "beta processing" which improved the resistance to stress corrosion cracking in Ti-6Al-4V. Beta processing involves annealing and/or hot working the material above the beta transus temperature. Beta-phase processing has improved the fracture properties of Ti-6Al-4V with little change in tensile properties. Further improvements in fracture properties as well as increased strength and greater metallurgical stability of titanium alloys were thought to be most readily obtainable through changes in alloy composition.

Although beta alloys combine high strength with good formability and, in some cases, good toughness and stress corrosion resistance, they inherently have low modulus and high density compared to alpha-beta type alloys. For this reason, it is an object of this invention to provide alpha-beta titanium alloys having low density and high modulus and exhibiting improved combinations of strength, toughness and stress corrosion resistance rendering them particularly useful for toughness-critical and strength-critical applications in both sheet gage and thick sections.

SUMMARY OF THE INVENTION

This invention is directed to titanium alloys of the compositions shown in Table 1. Preferably the elements are individually maintained within the preferred ranges indicated in Table 1.

TABLE 1

| Element | Broad Range (Weight %) | Preferred Range (Weight %) |
|---|---|---|
| Aluminum | 3.8 - 5.3 | 3.9 - 5.2 |
| Zirconium | 0 - 4.0 | 0 - 3.5 |
| Molybdenum | 2.5 - 4.25 | 2.5 - 3.5 |
| Vanadium | 2.5 - 4.25 | 2.5 - 3.5 |
| Chromium | 0 - 2.2* | 0 - 2.0** |
| Nickel | 0 - 1.0* | 0 - 0.8** |
| Iron | 0 - 1.50* | 0 - 1.0** |
| Titanium | Balance | Balance |

*(0.68 × %Cr) + (1.5 × %Ni) + (1 × %Fe) = from 0.5 to 1.5
**(0.50 × %Cr) + (1.25 × %Ni) + (1 × %Fe) = from 0.5 to 1.0

Within the alloy composition ranges set forth in Table 1, three narrow compositional ranges (see Table 2) are especially preferred. Compositions within the ranges set forth in Table 2 will provide unique combinations of strength, fracture toughness and stress corrosion resistance which usually will match or exceed the values set forth in Table 2*a*. Compositions in Ranges I and III are particularly suited for the production of thin sheet having high strength, good room temperature rollability and good hot formability in the duplex annealed condition. Compositions in Range II and also those in Range III exhibit high strength with good hardenability and hot forgeability rendering them especially applicable in plate and other thick section applications.

TABLE 2

| Element* | Composition - Weight % (Minimum - Aim - Maximum) Range I | Range II | Range III |
|---|---|---|---|
| Aluminum | 4.4-4.8-5.2 | 3.9-4.3-4.7 | 4.1-4.5-4.9 |
| Zirconium | — | 2.5-3.0-3.5 | 2.5-3.0-3.5 |
| Molybdenum | 2.5-3.0-3.5 | 2.5-3.0-3.5 | 3.25-3.75-4.25 |
| Vanadium | 2.5-3.0-3.5 | 2.5-3.0-3.5 | 3.25-3.75-4.25 |
| Other | 0.6-0.8-1.0Fe | 1.6-1.8-2.0Cr | 0.4-0.6—0.8Ni |
| Titanium | Balance | Balance | Balance |

*The maximum interstitial contents (weight %) preferably should be 0.11 oxygen, 0.03 nitrogen, 0.05 carbon and 0.0125 hydrogen; however, somewhat higher interstitial contents can be tolerated.

TABLE 2a

| Property | Range I Sheet | Range I Plate | Range II Sheet | Range II Plate | Range III Sheet | Range III Plate |
|---|---|---|---|---|---|---|
| TUS (ksi)* | 155 | 150 | 155 | 170 (160) | 155 | 170 (160) |
| TYS (ksi) | 140 | 135 | 140 | 155 | 140 | 155 |
| CYS (ksi) | 140 | 135 | 140 | 155 | 140 | 155 |
| Elong (%) | 10 | 8 | 10 | 8 | 10 | 8 |
| E (modulus) | 16 | 16 | 16 | 16 | 16 | 16 |
| $K_{Ic}$ (ksi $\sqrt{in}$) | — | 75 | — | 65 | — | 65 |
| $K_{Iscc}$ (ksi $\sqrt{in}$) | — | 60 | — | 55 | — | 55 |
| $K_c$ (ksi $\sqrt{in}$) | 150 | — | 130 | — | 150 | — |
| $K_{scc}$ (ksi $\sqrt{in}$) | 120 | — | 110 | — | 120 | — |

*Typical strengths are 15 ksi higher.
Note:
Sheet: duplex annealed, thickness = 0.050 in.;
Plate: solution treat and age, thickness = 0.50 in.
— values in parentheses are for 3 in. plate.

DETAILED DESCRIPTION OF THE INVENTION

The alloys of this invention have low densities (i.e., less than 0.17 lb./cu. in.) and high moduli (i.e., greater than 15 × $10^6$ psi) and exhibit superior fracture toughness and stress corrosion resistance (in aqueous environments) as compared to other, equal strength titanium alloys in the ultimate tensile strength range of 140 ksi to 210 ksi. In addition to the improved combinations of strength, toughness and stress corrosion resistance, the alloys of this invention offer excellent metallurgical stability and improved manufacturing capability compared to current commercial alloys. Duplex annealing of alloys of this invention to achieve high strength sheet material avoids the warpage that is generally encountered during treatments involving water quenching. Use of an 1100° F. aging temperature for both sheet and plate facilitates hot sizing, hot forming, and stress relieving operations, the uses of which are restricted in Ti-6Al-4V treatments because of the low aging temperatures required to achieve high strength levels.

Prior art alpha-beta titanium alloys usually contain relatively high contents of both the solid solution strengthening elements (aluminum, tin and zirconium) and interstitial strengthening elements (oxygen, carbon and nitrogen). In certain heat treatment conditions, the high contents of aluminum, tin and/or zirconium promote an embrittlement which can severely reduce fracture toughness and resistance to stress corrosion cracking. High contents of interstitial strengtheners promote similar effects on fracture properties. The addition of beta phase solid solution elements such as molybdenum, chromium, vanadium, iron and nickel have been used in the prior art to promote strength, but these elements add greatly to alloy density and tend to reduce alloy modulus. For aircraft applications, low density and high modulus provide for light weight, efficient aircraft structures.

In the alloys of this invention the interstitial elements oxygen, nitrogen and carbon are preferably maintained as low as economically feasible. The alpha phase is strengthened by amounts of aluminum, and optionally zirconium, in a narrow range which will provide high strength and yet maintain high fracture properties.

Beta phase stabilizers (Mo, V, Fe, Cr, and Ni) promote the ductile beta phase and thus enhance heat treatability and fabricability. It has been found that excessive amounts of these beta phase stabilizers not only increase density but also lower modulus and reduce toughness. The amounts of these elements are therefore maintained at levels found to increase strength, heat treatability and fabricability without severely reducing modulus or toughness.

The additions of relatively small amounts of beta eutectoid stabilizers (Fe, Ni and Cr) in combination with beta isomorphous stabilizers (Mo and V) provide definite advantages over additions of beta isomorphous stabilizers alone. Since the beta eutectoid stabilizers are more potent, the quantities required are less and hence alloy density is not as greatly increased. These beta eutectoid additions also usually promote air hardenability since decomposition of the metastable beta phase is more sluggish. Air hardenability provides better fabricability due to elimination of part distortion caused by conventional water quenching. The sluggish beta phase transformation also results in greater hardenability in thick sections. Notwithstanding the mentioned advantages of beta eutectoid stabilizers, it has been found that excessive amounts of these elements can cause formation of intermetallic compounds resulting in alloy embrittlement or instability. For this reason, iron, chromium and nickel in the alloys of this invention are used in quantities within low, narrow ranges and are used in combination with small amounts of beta isomorphous stabilizers.

Thus, the improved properties of the alloys of this invention are believed to result from: (1) limiting the aluminum and oxygen content to maxima of 5.3% and 0.13% and preferably 5.2% and 0.11%, respectively, to minimize coplanar slip, the formation of ordered domains, and/or the formation of $Ti_3Al$-type embrittling intermetallic compounds in the alpha phase; (2) the presence of beta isomorphous stabilizing elements, molybdenum and vanadium, in amounts which stabilize a significant percentage (e.g., 10 to 60 volume percent) of the ductile beta phase; (3) the presence of the beta eutectoid stabilizers, nickel, iron or chromium, in amounts which significantly increase alloy strength without causing embrittlement due to the formation of intermetallic compounds, e.g., $Ti_2Ni$, $Ti_2Fe$ and $Ti_2Cr$; and in alloys containing zirconium, the strengthening of the alpha phase by a solid solution mechanism without promoting coplanar slip, the formation of ordered domains or the formation of $Ti_3Al$-type intermetallic compounds. To assure optimum fracture properties, it will generally be desirable for the amounts of aluminum, zirconium, oxygen, nitrogen and carbon to be such as to satisfy the equation:

$$(1 \times \%Al) + (1/6 \times \%Zr) + (18 \times \%O) + (22 \times \%N) + (26 \times \%C) \leqq 7.5$$

The following terms and abbreviations used herein have the indicated meaning:

"alpha-beta alloy": a titanium alloy of such composition that both alpha and beta phases are stable at room temperature;

"alpha-beta processing": metal working of a titanium alloy at temperatures at which both alpha and beta phases are present; both phases generally recrystallize into a fine, globular or equiaxed structure;

"beta processing": metal working or annealing of an alphabeta titanium alloy at temperatures at which only the beta phase is present; on cooling the beta phase generally transforms to a basketweave morphology;

"beta-STA": a type of heat treatment that involves beta processing followed by solution treating and aging;

"CYS": compression yield strength, 0.2% offset;

"duplex annealing": a two-step annealing process involving a high temperature anneal (usually near the beta transus temperature) followed by a low temperature anneal or an aging treatment;

"E": Young's modulus for tension;

"Elong": percent elongation; the permanent strain generated in a tension specimen divided by standard gage length (4 × specimen width or diameter);

"$K_c$": critical stress — intensity factor; usually referred to as "plane stress fracture toughness;"

"$K_{Ic}$": critical stress — intensity factor, opening mode; usually referred to as "plane strain fracture toughness;"

"$K_{Iscc}$": plane strain stress — intensity factor, stress-corrosion cracking threshold; also referred to as "stress corrosion resistance;"

"$K_{scc}$": plane stress stress — intensity factor, stress-corrosion cracking threshold; also referred to as "sheet stress corrosion resistance;"

"STA": heat treatment process involving solution treating and aging;

"TUS": ultimate tension strength;

"TYS": tension yield strength, 0.2% offset.

The melting, forging, rolling and metallurgical evaluations of fourteen alloys of this invention (and other alloys for comparison purposes) are described in the following Examples. Preferably, the molybdenum and vanadium contents are such that the sum of (1.3 × %Mo) and (1 × %V) is from 6.1 to 8.7 (more preferably, from 6.1 to 7.5).

Beta phase stabilization in the alloys of this invention is primarily achieved through the inclusion of molybdenum and vanadium. Both elements are included because it has been shown that use of the combination results in better combinations of properties, i.e., strength, fracture toughness, stress corrosion resistance, modulus and density, then are obtained using either separately.

It will be seen from the following examples that the addition of 1% nickel to a Ti-5Al-3Mo-3V base alloy (see alloy 15, Example 1) increased toughness and stress corrosion resistance of STA plate by approximately 50% but reduced strength slightly. The reduction in strength is thought to be an anomaly because the strength of both DA plate and DA sheet increased with nickel addition. The 1% nickel addition also increased toughness. At a 150 ksi ultimate strength, duplex annealed Ti-5Al-3Mo-3V-1Ni is approximately 46% tougher and 80% more stress corrosion resistant than typical commercial grades of Ti-6Al-4V. Solution treated and aged Ti-5Al-3Mo-3V-1Ni at 170 ksi ultimate strength has fracture toughness and stress corrosion resistance which are superior to commercial grades of Ti-6Al-4V. Nickel additions of 1.5, 2.0 and 3.0 caused intermetallic particle formation and pronounced embrittlement of the Ti-5Al-3Mo-3V base alloy. Small reductions in fracture toughness were noted for $Ti_2Ni$ contents as low as approximately 0.1 vol. %. For example, alloy 24 (Example 2), which contained 0.2 vol. % $Ti_2Ni$ had reduced fracture properties compared to alloy 15 (Example 1) which was free of the $Ti_2Ni$ intermetallic phase based on X-ray and thin foil analysis. Ni additions of 1% or more to the Ti-5Al-3Mo-3V base alloy are too high to consistently maintain all the nickel in solid solution in the beta phase. However, reducing Ni to 0.5 wt.% (alloy 30, Example 2) avoided the formation of the embrittling $Ti_2Ni$ phase while retaining its beneficial effects on mechanical properties. (It has been shown that the formation of $Ti_2Ni$ can be suppressed by employing 5Mo, rather than 3Mo, in Ti-5Al-XMo-3V-1Ni alloys to stabilize additional beta phase and thereby dilute the Ni concentration in beta.)

The formation of $Ti_2Ni$-type intermetallics can be avoided by employing limited amounts of iron or chromium which are sluggish beta eutectoid stabilizers. The effect of 0.25%, 0.5%, 1.0% and 1.5% iron additions on the mechanical properties of Ti-5Al-3Mo-3V base alloy can be seen by comparing alloys 2 and 20-23 (Example 1). The additions increased strength and reduced toughness in DA sheet but had little affect on the properties of STA plate. This behavior is attributed to differences in the strengthening mechanisms in the two conditions and to changes in the strengthening mechanism with increasing iron. In low-iron, DA alloys, beta transformed extensively to lamellar alpha during the air cooling from the solution treatment temperature. The alpha formed in this manner is large and not an effective second phase particle strengthener. Additional iron increased the amount of beta retained during solution treatment. This beta strengthened the DA sheet by precipitating relatively fine alpha particles during aging. Therefore, increasing iron strengthens the DA condition by enhancing precipitation hardening as well as by solid solution hardening. More effective precipitation hardening is also thought to account for the increased affect of iron in DA sheet compared to DA plate. In the STA condition, "α" martensite strengthens the low iron alloys by precipitating a fine dispersion of beta in alpha during aging. This structure is a more effective strengthener than the dispersion of alpha in beta that is formed during aging of the high iron alloys. Chromium-containing alloy 41 (Example 2) exhibited excellent strength-toughness combinations in the beta-STA conditions and excellent strength-stress corrosion resistance combinations in alpha-beta processed, duplex annealed conditions. To assure strengths of 160 ksi in thick sections, chromium additions of about 1.8% are preferred (see Tables 2 and 2*a*, Range 2).

Increasing oxygen in the range of 0.07 to 0.16% strengthened the Ti-5Al-3Mo-3V-1Ni alloys (see Tables 11 and 12, alloys 24-26), but reduced fracture toughness and stress corrosion resistance. It is, therefore, preferred that the oxygen content not exceed 0.13% and more preferably not exceed 0.11%. (At oxygen contents within the range of 0.06 to 0.11, optimum strength is maintained without detracting from fracture properties.) For solution treated and aged (STA) plate, fracture toughness and stress corrosion resistance were found to decrease proportionally with increasing oxygen. However, in the duplex annealed (DA) condition, stress corrosion resistance decreased much more rapidly than fracture toughness. The adverse effect of oxygen on stress corrosion resistance properties is tentatively attributed to a restriction of slip in the alpha phase. Apparently, the minimum amount of oxygen which will restrict slip in alloys containing 5% aluminum (approximately 0.12–0.13%) is considerably less than in Al-free alloys. Heat treatment conditions containing a relatively large volume of alpha phase with a large grain size are affected most adversely by high oxygen levels. Of the two conditions tested in the following examples, the DA condition has more primary alpha of larger grain size than the STA condition and is more adversely affected by high oxygen levels.

Similarly to oxygen, increasing Al increases strength but decreases toughness and stress corrosion resistance. As with oxygen, the effect of increasing Al is greatest in heat treated conditions containing large volume fractions of alpha phase with large grain size.

Carbon was added to Ti-4.5Al-4Zr-3Mo-3V-.5Ni at a 0.10% (nominal) level. The added carbon increased strength but caused both elongation and reduction of area to decrease for both sheet and plate when compared to the base alloy. The nitrogen and carbon contents of the alloys of this invention should not exceed about 0.05% and 0.08%, respectively, to obtain optimum properties, and more preferably do not exceed about 0.03% and 0.05%, respectively.

Additions of 2.5Zr have been found to increase the strength, toughness and stress corrosion resistance of a Ti-5Al-3Mo-3V base alloy. Zirconium also improves properties when beta eutectoid stabilizers such as nickel are present in the base alloy. A 4Zr addition (alloy 31) increased strength but reduced toughness and stress corrosion resistance for both heat treatment conditions of 0.5 in. thick plate (see Table 11); however, the combination of strength, toughness and stress corrosion resistance of alloy 31 was superior to the zirconium free alloy (30). For 0.05 in. thick sheet material, the strength-toughness combinations of the two alloys were equivalent (see Table 12). Two levels of zirconium, 2 and 4%, were evaluated in a Ti-4.5Al-3Mo-3V-1Fe base alloy. The 4Zr alloy (34) had higher tensile strength but lower fracture properties than the 2Zr alloy (35). The strength-fracture property combination of alloy 35 was somewhat better than that of alloy 34. Preferably, the aluminum and zirconium contents in the alloys of this invention are such that the sum of (1 × %Al) and (1/6 × %Zr) is from 3.8 to 5.3 (more preferably, from 3.9 to 5.2).

EXAMPLE 1

Seven titanium alloys were prepared as eight-pound ingots as described hereinafter. The nominal alloy compositions are shown in Table 3. All alloys were prepared with Japanese titanium sponge, 110 BHN (680 ppm O).

Melting

For each alloy, a master alloy button containing all the alloying additions was prepared. Each button was crushed to ~$\frac{1}{8}$ inch particles, evenly distributed in the titanium sponge, and pressed to form two 567-gram and one 2500-gram compacts. The compacts were then fabricated into an electrode in a dry box by tungsten fusion welding and vacuum melted to form a 3-inch diameter ingot. The ingot was sectioned into thirds lengthwise and rewelded to form an electrode for a second melt. After final melting into a 3-inch diameter crucible, each ingot was sidewall turned to $2\frac{3}{4}$ inch diameter, sampled and analyzed. The results of the analyses are shown in Table 3.

Forging and Rolling

Following melting, the ingots were forged and hot rolled to $\frac{1}{2}$ inch thick plate. Forging was carried out on a steam powered drop hammer using the following procedure: (a) heat in 1900° F. furnace and hold 2 hours; (b) upset forge 50%; (c) reheat to 1900° F.; (d) draw out to $2\frac{3}{4}$ inch square in direction of ingot axis; (e) reheat to 1900° F.; (f) forge one half of ingot to 1 inch × $2\frac{3}{4}$ inches cross section; (g) reheat to 1900° F.; and (h) complete forging of second half of ingot to 1 inch × $2\frac{3}{4}$ inches × length. Final reduction to $\frac{1}{2}$-inch thick plate was accomplished by rolling the slab from 1900° F. without reheats in 5 passes at 0.1 inch per pass and air cooling. Rolling was conducted parallel to the slab length resulting in plate approximately $\frac{1}{2}$inch × $2\frac{3}{4}$ inches ×23 inches.

(STA) and duplex anneal (DA) treatments were selected for each alloy (Table 4). Solution treating temperatures were selected at approximately 25° F. below the beta transus for plate and 50° F. below the beta transus for sheet to limit the amount of primary alpha phase to less than 20%.

A portion of each plate (approximately 0.50 inches × 2.75 inches × 1.75 inches) was rolled to 0.050 inch sheet according to the following procedure: (1) heat plate in circulating air, electric furnace to 25° F. below beta transus temperature for 30 minutes (see Table 4); (2) roll in plate rolling direction to 0.15 inches × 2.75 inches × 4.8 inches; (3) reheat for 10 minutes at 125° F. below beta transus temperature; (4) cross roll to 0.10 inches × 3.9 inches × 4.8 inches; (5) grit blast and pickle in $HNO_3$-HF (14:1 ratio) at 120° F. to remove 0.001inches per side; (6) vacuum anneal at 1300° F. for 4 hours and furnace cool; (7) descale in Kolene (DGS-900° F.) and pickle; (8) warm roll alloys 0.075 inches × 7.8 inches × 4.8 inches at 800° F.; (9) anneal at 125° F. below beta transus temperature for 10 minutes, air cool, wet vapor blast and pickle; (10) roll to 0.050 inches from room temperature; (11) solution treat sheets at temperatures shown in Table 4, forced air cool, wet vapor blast and pickle; and (12) vacuum age at 1100° F. for 8 hours, furnace cool at 50° F. per hour to 800° F., wet vapor blast, and pickle.

Mechanical Property Evaluation

Two blanks $8\frac{1}{2}$ inches long were sawcut from each plate and heat treated to the STA or DA conditions described above. Two round tensile specimens (0.250 inches round and 1 inch gage length) and four notch bend specimens (0.440 inch × 1.5 inch × 2.5 inches) were machined from each blank so their long dimension

TABLE 3

| | | | Compositions of Alloys | | | | | | | | | | | |
|---|---|---|---|---|---|---|---|---|---|---|---|---|---|---|
| | | | Composition (Wt. %) | | | | | | | | | | | |
| | Alloy Designation | Analysis | Al | Mo | V | Cu | Ni | Fe | Si | Zr | N | H | C | O |
| 2. | Ti-5A1-3Mo-3V | A | 5.08 | 3.00 | 2.95 | — | — | — | — | — | .010 | .003 | .012 | .064 |
| | | B | 5.11 | 2.77 | 3.22 | — | — | .073 | — | — | .008 | .005 | .030 | .100 |
| 15. | Ti-5Al-3Mo-3V-1Ni | A | 5.10 | 3.08 | 2.95 | — | 0.82 | — | — | — | .009 | .002 | .008 | .078 |
| | | B | 5.12 | 3.22 | 2.80 | — | 1.00 | — | — | — | .010 | .003 | .030 | .139 |
| | | | | | | | | | | | | (.006) | | (.116) |
| 16. | Ti-5Al-3Zr-3Mo-3V | A | 5.03 | 3.06 | 3.08 | — | — | — | — | 1.85 | .011 | .002 | .008 | .071 |
| | | B | 5.04 | 3.10 | 3.38 | — | — | .051 | — | — | .008 | .004 | .02 | .104 |
| | | | | | | | | | | | | (.005) | | (.088) |
| 20. | Ti-5Al-3Mo-3V-1.5Fe | A | 4.85 | 3.08 | 2.95 | — | — | 1.69 | — | — | .006 | .001 | .009 | .069 |
| | | B | 5.08 | 3.06 | 2.85 | — | — | 1.48 | — | — | .006 | .003 | .035 | .093 |
| 21. | Ti-5Al-3Mo-3V-1Fe | A | 4.90 | 3.00 | 3.03 | — | — | 1.09 | — | — | .008 | .002 | .010 | .073 |
| | | B | 4.93 | 3.08 | 2.85 | — | — | 1.00 | — | — | .003 | .005 | .040 | .089 |
| 22. | Ti-5Al-3Mo-3V-.5Fe | A | 4.85 | 3.24 | 3.13 | — | — | .60 | — | — | .009 | .001 | .010 | .079 |
| | | B | 5.02 | 2.97 | 2.85 | — | — | .54 | — | — | .007 | .004 | .025 | .151 |
| | | | | | | | | | | | | (.007) | | (.108) |
| 23. | Ti-5Al-3Mo-3V-.25Fe | A | 4.90 | 2.88 | 3.00 | — | — | .33 | — | — | .008 | .001 | .014 | .081 |
| | | B | 4.99 | 2.94 | 2.91 | — | — | .36 | — | — | .006 | .003 | .035 | .078 |

Note:
"A" analyses of oxygen and hydrogen were from ingot tops. A sidewall blend was used for other elements.
"B" analyses were from an area near the edge and end of the rolled plates; values for oxygen and hydrogen shown in parentheses were obtained from near the necked area of tensile specimens.

The plate was sectioned to provide specimens for metallurgical and mechanical property evaluations. The beta transus temperature for each alloy (see Table 4) was determined using metallographic techniques. Samples for transmission electron microscopy studies were prepared from a 1-inch wide strip sawcut from each plate and milled to 0.020 inch thick. Coupons approximately $\frac{1}{2}$ inch square were cut from this milled stock and heat treated. From three to six heat treatments were examined for each alloy composition. Preliminary results of the transmission electron microscopy study were used to select heat treatment conditions for the mechanical property evaluation. Solution treat and age was transverse to the rolling direction. The notch bend specimen thickness of 0.440 inch was selected so that a minimum of 0.030 inch (oxygen containing depth) could be removed from both surfaces. The notched bend specimens were fatigue cracked by cyclic cantilever loading in a Sonntag SF-10-U fatigue machine prior to fracture toughness testing in air or stress corrosion testing in 3.5% NaCl solution. The cyclic loads were selected to initiate the precrack in about 40,000 cycles at K-levels between 25 ksi $\sqrt{\text{in.}}$ and 35 ksi $\sqrt{\text{in.}}$ All tests were conducted at room temperature.

In the fracture toughness testing, notched bend specimens were loaded to failure in four-point bending at a gross area stress rate of 1000 psi/sec. Extension arms were pinned to the subsize notched bend specimens to enable use of standard testing techniques. The extensions were designed so that the imposed stress distribution is identical to that formed in the standard 7.5 inches long notched bend specimen. Plane-strain fracture toughness, $K_{Ic}$, was calculated from each load-deflection curve using the method described in "Plane Strain Crack Toughness Testing of High Strength Materials," ASTM STP 410 (1966).

TABLE 4

Beta Transus Temperatures and Heat Treatment Schedules

| | Alloy Description | Solution Treatment Temperatures (° F.) Plate* | Sheet** | Beta Transus (° F.) |
|---|---|---|---|---|
| 2. | Ti-5Al-3Mo-3V | 1,675 | 1,650 | 1,700 |
| 15. | Ti-5Al-3Mo-3V-1Ni | 1,650 | 1,625 | 1,675 |
| 16. | Ti-5Al-3Zr-3Mo-3V | 1,640 | 1,625 | 1,650 |
| 20. | Ti-5Al-3Mo-3V-1.5Fe | 1,625 | 1,600 | 1,650 |
| 21. | Ti-5Al-3Mo-3V-1Fe | 1,650 | 1,625 | 1,700 |
| 22. | Ti-5Al-3Mo-3V-.5Fe | 1,650 | 1,625 | 1,675 |
| 23. | Ti-5Al-3Mo-3V-.25Fe | 1,675 | 1,650 | 1,700 |

*Solution treat 30 min. and either air cool (Duplex Anneal) or water quench (STA).
**Soluton treat 10 min. and forced air cool (Duplex Anneal).
After solution treatment, all alloys were aged at 1100° F. (for 8 hours, furnace cooled to 800° F. at 80° F./hr. (plate) or 50° F./hr. (sheet) and then air cooled.

In the stress corrosion test, notched bend specimens were immersed in salt solution prior to four-point loading in a hydraulic apparatus. Load levels for specimens were selected to establish a curve of initial stress intensity, $K_{Ii}$, versus time to failure. The specimens were loaded until failure or for a time of at least 6 hours. Visual monitoring of crack growth and examination of the fracture surface showed that the pre-existing crack propagated in salt solution at low K-levels until it reached the critical length (corresponding to $K_{Ic}$) necessary for rapid failure. An apparent "threshold level" for stress corrosion cracking exists in titanium alloys below which the pre-existing crack does not grow under sustained load. The threshold is defined as the $K_{Ii}$ level at 360 minutes and is referred to as $K_{Iscc}$ or "stress corrosion resistance." This value can be compared with the fracture toughness in air, $K_{Ic}$, to establish "relative susceptibility."

For each heat treatment condition, one notched bend specimen was tested to establish the baseline $K_{Ic}$. The remaining three specimens were tested to establish the stress corrosion threshold, $K_{Iscc}$. Fracture toughness and stress corrosion resistance values for plate material are reported in Table 5.

The two tensile specimens were tested in the as-heat-treated condition; tensile properties of plate materials are reported in Table 5.

The alloys were additionally characterized by testing the 0.050 inch gage sheets in the duplex annealed heat treatment condition. Longitudinal and transverse tensile specimens from each sheet were tested. Charpy specimens were sawcut from each sheet and in each grain direction and were precracked prior to impact testing. Sheet properties are shown in Table 6.

TABLE 5

Mechanical Properties of Titanium Alloy Plate*

| | Alloy Designation | Condition** | Tensile TUS (ksi) | TYS (ksi) | Elong. (% in 1") | R.A. (%) | E ($10^{-6}$ psi) | Fracture Toughness $K_{Ic}$ (ksi $\sqrt{in}$) | Stress Corrosion $K_{Iscc}$ (ksi $\sqrt{in}$) |
|---|---|---|---|---|---|---|---|---|---|
| 2. | Ti-5Al-3Mo-3V | DA | 142.6 | 129.3 | 14 | 35 | 17 | 130 | 123 |
| | | STA | 174.3 | 155.0 | 8 | 20 | 20 | 71 | 48 |
| 15. | Ti-5Al-3Mo-3V-1Ni | DA | 152.2 | 142.3 | 13.5 | 29 | 18 | 133 | 103 |
| | | STA | 169.0 | 153.1 | 15 | 27 | 17 | 105 | 83 |
| 16. | Ti-5Al-3Zr-3Mo-3V | DA | 152.1 | 137.5 | 10.5 | 35 | 18 | 128 | 108 |
| | | STA | 177.4 | 163.2 | 6.5 | 20 | 18 | 76 | 63 |
| 20. | Ti-5Al-3Mo-3V-1.5Fe | DA | 160.3 | 148.3 | 9.5 | 29 | 17 | 115 | 87 |
| | | STA | 176.8 | 165.9 | 6.5 | 15 | 17 | 75 | 60 |
| 21. | Ti-5Al-3Mo-3V-1Fe | DA | 154.4 | 142.2 | 11 | 29 | 18 | 127 | 85 |
| | | STA | 176.6 | 167.3 | 11.5 | 15 | 17 | 77 | 50 |
| 22. | Ti-5Al-3Mo-3V-.5Fe | DA | 147.6 | 132.5 | 10.5 | 29 | 18 | 132 | 115 |
| | | STA | 165.0 | 152.2 | 8.5 | 19 | 18 | 81 | 55 |
| 23. | Ti-5Al-3Mo-3V-.25Fe | DA | 145.2 | 137.4 | 13.5 | 40 | 18 | 135 | 115 |
| | | STA | 175.8 | 163.9 | 8 | 23 | 17 | 68 | 65 |

*Average transverse properties.
**DA (Duplex Anneal) and STA (Solution Treat and Age) heat treatments are shown in Table 4.

TABLE 6

Mechanical Properties of .050 Gage Titanium Alloy Sheet*

| | Alloy Designation | Grain Direction | TUS (ksi) | TYS (ksi) | Elong. (% in 1") | E × $10^{-6}$ (psi) | Fracture Energy W/A (in-lbs/in²) |
|---|---|---|---|---|---|---|---|
| 2. | Ti-5Al-3Mo-3V | Long. | 160.4 | 150.8 | 12.5 | 20 | 1003 |
| | | Trans. | 162.5 | 152.7 | 14 | 16 | 1369 |
| | | Avg. | 161.4 | | | | 1186 |
| 15. | Ti-5A-3Mo-3V-1Ni | Long | 169.7 | 165.0 | 12 | 16 | 1349 |
| | | Trans. | 171.0 | 166.0 | 10 | 16 | 1474 |
| | | Avg. | 170.4 | | | | 1412 |
| 16 | Ti-5Al-3Zr-3Mo-3V | Long. | 163.8 | 156.2 | 11 | 16 | 1073 |
| | | Trans. | 163.0 | 154.0 | 13 | 15 | 2310 |
| | | Avg. | 163.4 | | | | 1692 |
| 20. | Ti-5Al-3Mo-3V-1.5Fe | Long. | 187.0 | 178.3 | 9.5 | 17 | 877 |
| | | Trans. | 183.8 | 175.2 | 9 | 17 | 1171 |
| | | Avg. | 185.4 | | | | 1024 |
| 21. | Ti-5Al-3Mo-3V-1Fe | Long. | 184.5 | 173.6 | 10 | 16 | 173 |
| | | Trans. | 182.3 | 170.5 | 11.5 | 16 | 969 |
| | | Avg. | 183.4 | | | | 841 |
| 22. | Ti-5Al-3Mo-3V-.5Fe | Long. | 166.6 | 158.0 | 12 | 16 | 1327 |
| | | Trans. | 160.4 | 151.8 | 12 | 16 | 1972 |
| | | Avg. | 163.5 | | | | 1650 |

TABLE 6-continued

| Mechanical Properties of .050 Gage Titanium Alloy Sheet* | | | | | | |
|---|---|---|---|---|---|---|
| Alloy Designation | Grain Direction | TUS (ksi) | TYS (ksi) | Elong. (% in 1") | E × $10^{-6}$ (psi) | Fracture Energy W/A (in-lbs/in²) |
| 23. Ti-5Al-3Mo-3V-.25Fe | Long. | 162.2 | 152.6 | 13 | 16 | 1451 |
| | Trans. | 161.8 | 151.7 | 12.5 | 16 | 1629 |
| | Avg. | 162.0 | | | | 1540 |

*Heat treatment to duplex annealed condition (see Table 4).

EXAMPLE 2

Ten additional alloys, having the nominal compositions shown in Table 7, were produced as 8- or 20-pound ingots as described below.

Alloys 24-26 and 28 (alloy 28, Ti-6Al-4V, being included for reference purposes) were prepared as 3 inch diameter, 8-pound ingots and subsequently forged and rolled to ½ inch thick plate and 0.05 inch plate using the procedure described in Example 1 with the following modifications: sheet hot rolling was conducted at 50° F. and 150° F. below the beta transus temperatures (see Table 8) rather than 25° F. and 125° F. below, as in Example 1; and in step (9), alloys 24–26 were furnace cooled, rather than air cooled.

Alloys 30, 31, 33–35 and 41 (having nominal composition shown in Table 7) were prepared in 5-inch diameter, 20-pound ingots with ICI (British) titanium sponge, 0.05 wt. % O, 0.5 wt. % NaCl.

Melting

Each ingot was prepared from ten, 2-pound compacts consisting of a blend of titanium sponge and alloying elements in the proportions required for the particular alloy. The compacts were fabricated into electrodes in a dry box by tungsten fusion welding and vacuum melted into 5-inch diameter ingots. The ingots were sectioned into quarters lengthwise and rewelded to form electrodes for the second melt. After final melting into a 5-inch diameter crucible, the ingots were sidewall turned to 4¾ inch diameter, sampled and analyzed. Results of the analyses are shown in Table 7.

Forging

The ingots were forged to slabs using the following procedures: (a) heat to hot forging temperature shown in Table 8 and hold 2 hours; (b) draw out to 3 in. × 4 in. cross section; (c) reheat to hot forging temperature (Table 8); (d) draw out to slab 1¾ in. × 4 in. × length (approximately 19 in.); (e) trim ends and machine slab to 1.5 inch thickness; and (f) sawcut slab into 5 pieces; 2 pieces 1.5 in. × 4 in. × 6 in. (for plate rolling), 2 pieces 1.5 in. × 4 in. × 3 in. (for sheet rolling), and 1 piece 1.5 in. × 4 in. × 1 in. (for dynamic hardness measurement).

Rolling

The forged slabs were hot rolled to ½ inch thick plate and hot and cold rolled to 0.05 inch thick sheet. The beta transus temperatures of the alloys (see Table 8) were determined using metallographic techniques. The procedure for plate, which yeilded 2 pieces, approximately 0.5 in. × 6 in. × 11 in. was as follows: (a) heat 1.5 in. × 4 in. × 6 in. slab to plate hot rolling temperature shown in Table 8; (b) roll normal to slab axis (cross roll) to 1.0 in. × 6 in. × 6 in. in approximately 5 passes; (c) reheat to plate hot rolling temperature (Table 8); and (d) roll parallel to slab axis (direct roll) to 0.5 in. × 6 in. × 11 in. in approximately 5 passes.

TABLE 7

| Compositions of Alloys | | | | | | | | | | | | |
|---|---|---|---|---|---|---|---|---|---|---|---|---|
| | | Composition (Wt. %) | | | | | | | | | | |
| Alloy Designation | Analysis | Al | Mo | V | Cr | Ni | Fe | Zr | N | H | C | O |
| 24. Ti-5Al-3Mo-3V-1Ni-.07 $O_2$ | A | 4.75 | 3.08 | 2.70 | — | .82 | .07 | — | .007 | .001 | .017 | .068 |
| | B | 4.60 | 2.45 | 3.28 | — | .80 | .26 | — | .006 | .006 | .015 | .067 |
| | $B_1$ | 4.25 | 2.23 | 2.95 | — | .71 | .24 | — | .007 | .008 | .030 | — |
| | $B_2$ | 4.55 | 2.67 | 2.93 | — | .90 | .06 | — | .006 | .008 | .005 | .077 (.078) |
| 25. Ti-5Al-3Mo-3V-1Ni-.13 $O_2$ | A | 5.1 | 2.82 | 3.12 | — | .93 | .10 | — | .008 | .001 | .025 | .130 |
| | B | 4.90 | 2.51 | 3.28 | — | .87 | .24 | — | .006 | .007 | .020 | .125 |
| | $B_1$ | 4.63 | 2.76 | 3.15 | — | .97 | .11 | — | .006 | .008 | .015 | .126 (.115) |
| 26. Ti-5Al-3Mo-3V-1Ni-.16 $O_2$ | A | 5.05 | 2.80 | 2.98 | — | .77 | .09 | — | .007 | .001 | .016 | .165 |
| | B | 4.95 | 2.50 | 3.56 | — | 1.09 | .42 | — | .008 | .007 | .015 | .157 |
| | $B_1$ | 4.94 | 2.97 | 3.15 | — | .87 | .08 | — | .007 | .007 | .025 | — (.150) |
| 28. Ti-6Al-4V | A | 6.03 | — | 3.95 | — | — | .07 | — | .008 | .001 | .011 | .067 |
| | B | 5.75 | — | 4.48 | — | — | .33 | — | .007 | .008 | .010 | .089 |
| | $B_1$ | 6.05 | — | 4.35 | — | — | .09 | — | .007 | .006 | .015 | .067 (.068) |
| 30. Ti-4.5Al-3Mo-3V-.5Ni | A | 4.70 | 2.84 | 2.60 | — | .48 | .06 | — | .012 | .0023 | .034 | .115 |
| | B | 4.43 | 2.85 | 3.38 | — | .44 | .06 | — | .011 | .0023 | .020 | .119 (.126) |
| 31. Ti-4.5Al-4Zr-3Mo-3V-.5Ni | A | 4.57 | 3.12 | 2.68 | — | .51 | .06 | 4.04 | .009 | .0019 | .014 | .130 |
| | B | 4.24 | 2.67 | 2.48 | — | .39 | .05 | 3.84 | .010 | .0028 | .01 | .136 (.122) |
| 33. Ti-4.5Al-4Zr-3Mo-3V-.25Ni-.5Fe | A | 4.87 | 2.72 | 2.60 | — | .22 | .49 | 4.25 | .015 | .0018 | .016 | .115 |
| | B | 4.50 | 2.78 | 2.26 | — | .18 | .46 | 4.04 | .014 | .0026 | .030 | .121 (.096) |
| 34. Ti-4.5Al-4Zr-3Mo-3V-1Fe | A | 4.67 | 2.88 | 2.55 | — | — | 1.00 | 3.98 | .017 | .0022 | .019 | .120 |
| | B | 4.37 | 2.93 | 2.31 | — | — | .94 | 2.78 | .021 | .0025 | .010 | .115 (.127) |
| 35. Ti-4.5Al-2Zr-3Mo-3V-1Fe | A | 4.65 | 3.08 | 2.55 | — | — | .96 | 2.17 | .017 | .0017 | .017 | .125 |
| | B | 4.30 | 2.82 | 2.24 | — | — | .91 | 1.91 | .017 | .0025 | .020 | .124 (.112) |
| 41. Ti-4.5Al-4Zr-3Mo-3V-1Cr | A | 4.72 | 2.88 | 2.50 | 1.25Cr | — | .05 | 4.04 | .051 | .0016 | .013 | .125 |
| | B | 4.35 | 2.74 | 2.33 | .79Cr | — | .19 | 3.88 | .063 | .0027 | .025 | .115 |

TABLE 7-continued

| Alloy Designation | Analysis | Compositions of Alloys: Composition (Wt. %) Al | Mo | V | Cr | Ni | Fe | Zr | N | H | C | O |
|---|---|---|---|---|---|---|---|---|---|---|---|---|
| | | | | | | | | | | | | (.130) |

Note:
"A" analyses for oxygen and hydrogen were an average of readings from ingot tops and bottoms, other elements were analyzed using a sidewall blend.
"B" analyses were from broken tensile or notch bend specimens, the following techniques being used: oxygen, vacuum fusion (except values in parenthesis were by neutron activation); hydrogen, hot extraction; and nitrogen, micro Kjeldahl.

Two rolling schedules were employed for sheet. The schedule described below incorporates a hot cross rolling operation to minimize directionality. The second schedule involves only direct rolling. The former schedule was as follows: (1) heat 1.5 in. × 4 in. × 2.5 in. slab section to sheet hot rolling temperature (Table 8) and hold for 90 minutes; (2) roll parallel to slab axis (direct roll) to 0.9 in. × 4 in. × 4.5 in.; (3) reheat to sheet hot rolling temperature and hold for 60 minutes; (4) roll normal to original slab axis (cross roll) to 0.192 in. × 15 in. × 4.5 in.; (5) cut into 3 pieces, 0.192 in. × 5 in. × 4.5 in. each; (6) heat to sheet hot rolling temperature and hold for 10 minutes; (7) roll parallel to original slab axis to 0.120 × 5 in. × 7.5 in.; (8) trim, grit blast, and pickle (.005 in. gage removal) using 15% $HNO_3$ — 3% HF at 140° F.; (9) vacuum box anneal 1450° F./4 hrs./furnace cool (less than 150° F. per hour); (10) solution anneal 1450° F./10 min./air cool; (11) grit blast, and pickle (.002 in. gage removal using 33% $HNO_3$ — 1.7% HF at 140° F.; (12) cold roll parallel to original slab axis to .0735 in. × 5 in. × 10 in. at room temperature and clean; (13) vacuum box anneal (1450° F./4 hours/furnace cool; (14) solution anneal 1450° F./10 min./air cool; (15) wet vapor blast and pickle (0.002 in. gage removal) using 33% $HNO_3$ — 1.7% HF at 140° F.; (16) cold roll to 0.050 in. × 5 in. × 14 in. and clean; (17) solution anneal at approximately 50° F. below beta transus temperature (see Table 8), air cool, wet vapor blast and pickle; (18) trim ends to final dimension; and (19) vacuum age 1 of the 3 sheets per heat at 1100° F./8 hrs./furnace cool at 50° F./hr. to 800° F., wet vapor blast and pickle.

In general, the alloys of this invention hot rolled like Ti-6Al-4V. The alloys performed better than Ti-6Al-4V during cold rolling operations as evidenced by a low degree of edge cracking. Surface cracks did appear on about 25% of the sheets during cold rolling from 0.120 inch gage to 0.050 inch gage. However, cracking appeared to be related to incomplete removal of the alpha case during wet vapor blasting and pickling and not to chemical composition.

TABLE 8

Beta Transus and Hot Working Temperatures

| Alloy Designation | Beta Transus (° F) | Hot Working Temperature: Forging (° F) | Plate Rolling (° F) | Sheet Rolling (° F) |
|---|---|---|---|---|
| 24. Ti-5Al-3Mo-3V-1Ni-.07 $O_2$ | 1650 | 1900 | 1900 | 1600<br>1500 |
| 25. Ti-5Al-3Mo-3V-1Ni-.13 $O_2$ | 1675 | 1900 | 1900 | 1625<br>1525 |
| 26. Ti-5Al-3Mo-3V-1Ni-.16 $O_2$ | 1675 | 1900 | 1900 | 1625<br>1525 |
| 28. Ti-6Al-4V | 1750 | 1900 | 1900 | 1700<br>1600 |
| 30. Ti-4.5Al-3Mo-3V-.5Ni | 1750 | 1825 | 1700 | 1700 |
| 31. Ti-4.5Al-4Zr-3Mo-3V-.5Ni | 1700 | 1800 | 1660 | 1650 |
| 33. Ti-4.5Al-4Zr-3Mo-3V-.25Ni-.5Fe | 1700 | 1800 | 1660 | 1650 |
| 34. Ti-4.5Al-4Zr-3Mo-3V-1Fe | 1675 | 1800 | 1660 | 1650 |
| 35. Ti-4.5Al-2Zr-3Mo-3V-1Fe | 1700 | 1800 | 1660 | 1650 |
| 41. Ti-4.5Al-4Zr-3Mo-3V-1Cr | 1725 | 1800 | 1660 | 1650 |

Dynamic hardness tests were conducted on the trimmed slab ends and a Ti-6Al-4V reference specimen (alloy 28) to estimate the hot rollability of the alloys of this invention relative to Ti-6Al-4V. Results of tests at 1550° F., 1650° F., 1750° F. and 1850° F. are shown in Table 9. At 1550° F, all the alloys show higher hot hardness, or greater resistance to hot deformation, than Ti-6Al-4V. However, at temperatures of 1650° F and above, the experimental alloys are generally equal to or softer than Ti-6Al-4V. Actual response to hot forging and hot rolling operations was good for all alloys.

TABLE 9

Dynamic Hot Hardness Numbers at Four Elevated Temperatures

| Alloy Designation | Test Temperature (° F) 1550 | 1650 | 1750 | 1850 |
|---|---|---|---|---|
| 28. Ti-6Al-4V | 184 | 156 | 115 | 83 |
| 30. Ti-4.5Al-3Mo-3V-.5Ni | 182 | 125 | 84 | 68 |
| 31. Ti-4.5Al-4Zr-3Mo-3V-.5Ni | 206 | 112 | 94 | 76 |
| 33. Ti-4.5Al-4Zr-3Mo-3V-.25Ni-.5Fe | 201 | 144 | 101 | 78 |
| 34. Ti-4.5Al-4Zr-3Mo-3V-1Fe | 212 | 154 | 98 | 81 |
| 35. Ti-4.5Al-2Zr-3Mo-3V-1Fe | 192 | 131 | 85 | 75 |
| 41. Ti-4.5Al-4Zr-3Mo-3V-1Cr | 197 | 154 | 105 | 84 |

Mechanical Property Evaluation

The as-received plates were sawcut into blanks and heat treated according to the schedule shown in Table 10. Two round tensile specimens (0.250 in. dia. × 1 in. gage length) and four notched bend specimens (0.440 in. × 1.5 in. × 2.7 in.) were machined from each blank (except 35BL) so their long dimension was transverse to the rolling direction. The notch orientation of the notched bend specimens was WR. Longitudinal specimens (notch orientation RW) were prepared from blank 35BL. The notched bend specimens were fatigue precracked in a Vibraphone machine at a maximum K level of 28.4 ksi $\sqrt{in.}$ prior to test.

All tensile and notch bend specimens were tested at room temperature. One notched bend specimen per condition was loaded to failure in four-point bending to determine $K_{Ic}$. The remaining three specimens were immersed in 3.5% NaCl solution and then sustain loaded to determine $K_{Iscc}$.

Sheet material was evaluated in the duplex annealed heat treatment conditions shown in Table 10. Strength and toughness characteristics were determined using duplicate tensile specimens (1 inch gage length) and triplicate pre-cracked Charpy impact specimens. These properties were evaluated for both the longitudinal and transverse grain directions.

Tensile and fracture property results for the plate material and sheet material are shown in Tables 11 and 12, respectively.

TABLE 10

| Heat Treatment Schedules | | | |
|---|---|---|---|
| | Beta Anneal | Solution Treatment Temperature (° F.) | |
| Alloy Designation | Temperature (° F.) Plate* | Plate** | Sheet*** |
| 24. Ti-5Al-3Mo-3V-1Ni-.07 $O_2$ | — | 1625 | 1600 |
| 25. Ti-5Al-3Mo-3V-1Ni-.13 $O_2$ | — | 1650 | 1625 |
| 26. Ti-5Al-3Mo-3V-1Ni-.16 $O_2$ | — | 1650 | 1625 |
| 28. Ti-6Al-4V | — | 1725 | 1725 |
| 30. Ti-4.5Al-3Mo-3V-.5Ni | 1800 | 1725 | 1700 |
| 31. Ti-4.5Al-4Zr-3Mo-3V-.5Ni | 1750 | 1675 | 1650 |
| 33. Ti-4.5Al-4Zr-3Mo-3V-.25Ni-.5Fe | 1750 | 1675 | 1650 |
| 34. Ti-4.5Al-4Zr-3Mo-3V-1Fe | 1725 | 1650 | 1625 |
| 35. Ti-4.5Al-2Zr-3Mo-3V-1Fe | 1750 | 1675 | 1650 |
| 41. Ti-4.5Al-4Zr-3Mo-3V-1Cr | 1775 | 1700 | 1675 |

*Beta anneal 20 min. and air cool prior to solution treatment (conditions AA, BB, BL, and C only -- see Table 11).

**Solution treat 30 min. and either air cool (conditions A and AA) or water quench (conditions B, BB, BL, and C).

***Solution treat 10 min. and air cool.

All samples were aged after solution treatment. Conditions A, AA, B, BB, and BL were aged at 1100° F. for 8 hours and furnace cooled at 80° F./hr. (plate) or 50° F./hr. (sheet) to 800° F., then air cooled. Condition C was aged at 1150° F. Sheet material for all alloys except 24, 25, 26, 28 and 31 was hot flattened at 1100° F. for 1½ hours and furnace cooled as described above after aging.

TABLE 11

| Mechanical Properties of Alloy Plate* | | | | | | | | |
|---|---|---|---|---|---|---|---|---|
| | | Tensile | | | | | Fracture Toughness | Stress Corrosion |
| | | TUS | TYS | Elong. | R.A. | E | $K_{Ic}$ | $K_{Iscc}$ |
| Alloy and Condition | | (ksi) | (ksi) | (% in 1") | (%) | ($10^{-6}$ psi) | (ksi $\sqrt{in.}$) | (ksi $\sqrt{in.}$) |
| 24. Ti-5Al-3Mo-3V-1Ni-.07 $O_2$ | A | 139.3 | 126.0 | 10 | 25 | 17.5 | 115 | 95 |
| | B | 165.3 | 159.2 | 6 | 15 | 15.8 | 70 | 59 |
| 25. Ti-5Al-3Mo-3V-1Ni-.13 $O_2$ | A | 153.9 | 141.6 | 11 | 30 | 17.2 | 110 | 70 |
| | B | 174.9 | 162.5 | 3 | 11 | 19.5 | 61 | 48 |
| 26. Ti-5Al-3Mo-3V-1Ni-.16 $O_2$ | A | 164.7 | 152.2 | 10.5 | 24 | 19.1 | 102 | 26 |
| | B | 183.4 | 171.5 | 5 | 10 | 17.4 | 49 | 35 |
| 28. Ti-6Al-4V | A | 128.3 | 114.5 | 12.5 | 35 | 17.0 | 122 | 115 |
| | B | 149.0 | 136.7 | 10 | 28 | 17.8 | 125 | 87 |
| 30. Ti-4.5Al-3Mo-3V-.5Ni | A | 150.3 | 144.3 | 13.5 | 41 | 17.9 | 98 | 76 |
| | B | 176.3 | 170.5 | 12.5 | 47 | 18.1 | 63 | 52 |
| | BB | 178.2 | 166.4 | 6.5 | 12 | 17.3 | 78 | 62 |
| 31. Ti-4.5Al-4Zr-3Mo-3V-.5Ni | A | 161.6 | 155.4 | 13 | 40 | 17.5 | 87 | 52 |
| | AA | 161.4 | 146.9 | 9 | 20 | 17.5 | 116 | 70 |
| | B | 185.2 | 180.6 | 11 | 39 | 17.6 | 58 | 48 |
| | BB | 192.2 | 181.2 | 4.5 | 8 | 17.3 | 65 | 48 |
| | C | 174.5 | 161.9 | 5 | 13 | 17.4 | 85 | 54 |
| 33. Ti-4.5Al-4Zr-3Mo-3V-.25Ni-.5Fe | A | 163.6 | 156.6 | 14 | 45 | 17.4 | 66 | 47 |
| | B | 187.5 | 187.5 | 10 | 34 | 17.6 | 47 | 36 |
| | BB | 197.0 | 185.7 | 3 | 4 | 17.4 | 56 | 35 |
| 34 Ti-4.5Al-4Zr-3Mo-3V-1Fe | A | 169.1 | 162.1 | 13.5 | 42 | 18.1 | 46 | 33 |
| | AA | 169.8 | 152.2 | 9.5 | 19 | 17.6 | 78 | 36 |
| | B | 191.8 | 188.7 | 8.5 | 26 | 17.6 | 34 | 29 |
| | BB | 201.5 | 184.6 | 2.5 | 5 | 17.4 | 49 | 22 |
| 35. Ti-4.5Al-2Zr-3Mo-3V-1Fe | A | 164.6 | 155.2 | 14.5 | 46 | 18.4 | 53 | 39 |
| | B | 193.9 | 185.3 | 7.5 | 24 | 17.8 | 39 | 36 |
| | BB | 197.6 | 188.6 | 2.5 | 3 | 17.1 | 54 | 26 |
| | BL | (190.8) | (176.6) | (2) | (4) | (17.4) | (51) | (23) |
| 41. Ti-4.5Al-4Zr-3Mo-3V-Cr | A | 178.9 | 168.5 | 11.5 | 38 | 17.3 | 48 | 33 |
| | B | 204.0 | 196.0 | 6.5 | 21 | 17.4 | 31 | 27 |
| | BB | 215.5 | 205.9 | 3 | 3 | 16.9 | 43 | 25 |

*Average transverse properties except those in parentheses which are for longitudinal grain direction.

**A and AA ar duplex anneal heat treatment conditions, e.g. solution treat/furnace cool. + air cool (see Table 10).
B, BB, BL and C are solution treat and age conditions, e.g. solution treat/water quench + age (see Table 10).

TABLE 12

| Mechanical Properties of .050 Gage Titanium Alloy Sheet* | | | | | | | |
|---|---|---|---|---|---|---|---|
| | | Tensile | | | | | Fracture Energy |
| Alloy Designation | Grain Direction | TUS (ksi) | TYS (ksi) | Elong. (% in 1") | R.A. (%) | $E \times 10^{-6}$ (psi) | W/A (in-lbs/in$^2$) |
| 24. Ti-5Al-3Mo-3V-1Ni-.07 $O_2$ | Long. | — | 13 | — | — | — | — |
| | Trans. | 151.5 | — | 12 | — | — | 913** |
| | Avg. | — | | | | | — |
| 25. Ti-5Al-3Mo-3V-1Ni-.13 $O_2$ | Long. | 164.7** | — | 18 | — | — | 1565*** |
| | Trans. | 162.0*** | — | 18 | — | — | 933** |
| | Avg. | 163.4 | | | | | 1249 |

TABLE 12-continued

| Alloy Designation | Grain Direction | Tensile TUS (ksi) | Tensile TYS (ksi) | Tensile Elong. (% in 1") | Tensile R.A. (%) | Tensile $E \times 10^{-6}$ (psi) | Fracture Energy W/A (in-lbs/in²) |
|---|---|---|---|---|---|---|---|
| Mechanical Properties of .050 Gage Titanium Alloy Sheet* | | | | | | | |
| 26. Ti-5Al-3Mo-3V-1Ni-.16 $O_2$ | Long. | — | — | — | — | — | |
| | Trans. | 170.5 | — | 17 | — | — | 486*** |
| | Avg. | — | | | | | — |
| 28. Ti-6Al-4V | Long. | 128.8 | — | 14 | — | — | — |
| | Trans. | 130.0 | — | 18 | — | — | 2757** |
| | Avg. | — | | | | | — |
| 30. Ti-4.5Al-3Mo-3V-.5Ni | Long. | 170.0 | 159.8 | 11 | 25 | 17.0 | 1313 |
| | Trans. | 169.6 | 163.1 | 12 | 34 | 17.5 | 1353 |
| | Avg. | 169.8 | | | | | 1333 |
| 31. Ti-4.5Al-4Zr-3Mo-3V-.5Ni | Long. | 172.0 | 162.6 | 11.5 | 22 | 16.1 | 855 |
| | Trans. | 178.9 | 176.9 | 13 | 41 | 17.2 | 1214 |
| | Avg. | 175.5 | | | | | 1035 |
| 33. Ti-4.5Al-4Zr-3Mo-3V-.25Ni-.5Fe | Long. | 185.6 | 175.7 | 10 | 23 | 16.3 | 614 |
| | Trans. | 189.8 | 183.3 | 10.5 | 26 | 16.6 | 528 |
| | Avg. | 187.7 | | | | | 571 |
| 34. Ti-4.5Al-4Zr-3Mo-3V-1Fe | Long. | 187.5 | 177.2 | 8.5 | 21 | 16.2 | 350 |
| | Trans. | 191.4 | 185.7 | 11 | 29 | 16.7 | 263 |
| | Avg. | 189.5 | | | | | 307 |
| 35. Ti-4.5Al-2Zr-3Mo-3V-1Fe | Long. | 185.3 | 173.8 | 9.5 | 26 | 16.4 | 509 |
| | Trans. | 188.0 | 180.3 | 10 | 31 | 17.2 | 459 |
| | Avg. | 186.7 | | | | | 484 |
| 41. Ti-4.5Al-4Zr-3Mo-3V-1Cr | Long. | 200.8 | 190.0 | 7.5 | 12 | 16.4 | 224 |
| | Trans. | 206.6 | 197.1 | 8 | 19 | 16.8 | 163 |
| | Avg. | 203.7 | | | | | 194 |

*Results shown are an average of two tensile tests and three pre-cracked Charpy impact tests per direction unless otherwise noted. Duplex annealed condition (see Table 10).
**Average of two tests.
***One test only.

What is claimed is:

1. Alpha-beta phase titanium base alloys consisting essentially of from 3.9% to 4.7% aluminum, from 2.5% to 3.5% zirconium, from 2.5% to 3.5% molybdenum, from 2.5% to 3.5% vanadium and from 1.6% to 2.0% chromium, and containing no more than about 0.13% oxygen, 0.05% nitrogen and 0.08% carbon, oxygen, nitrogen and carbon being impurities, the balance being essentially titanium.

2. Titanium alloys of claim 1 containing no more than about 0.11% oxygen, 0.03% nitrogen and 0.05% carbon.

3. Titanium alloys of claim 1 consisting essentially of about 4.3% aluminum, about 3.0% zirconium, about 3.0% molybdenum, about 3.0% vanadium and about 1.8% chromium.

4. Titanium alloys of claim 3 containing no more than about 0.11% oxygen, 0.03% nitrogen and 0.05% carbon.

5. Titanium alloys consisting essentially of from 4.1% to 4.9% aluminum, from 2.5% to 3.5% zirconium, from 3.25% to 4.25% molybdenum, from 3.25% to 4.25% vanadium and from 0.4% to 0.8% nickel, and containing no more than about 0.13% oxygen, 0.05% nitrogen and 0.08% carbon, oxygen, nitrogen and carbon being impurities, the balance being essentially titanium.

6. Titanium alloys of claim 5 containing no more than about 0.11% oxygen, 0.03% nitrogen and 0.05% carbon.

7. Titanium alloys of claim 5 consisting essentially of about 4.5% aluminum, about 3.0% zirconium, about 3.75% molybdenum, about 3.75% vanadium, and about 0.6% nickel.

8. Titanium alloys of claim 7 containing no more than about 0.11% oxygen, 0.03% nitrogen and 0.05% carbon.

* * * * *